United States Patent [19]

Scheiber

[11] Patent Number: 4,798,312

[45] Date of Patent: Jan. 17, 1989

[54] FLUID DISPENSER

[76] Inventor: John G. Scheiber, 4252 N. Rangeline Rd., Huntington, Ind. 46750

[21] Appl. No.: 2,456

[22] Filed: Jan. 12, 1987

[51] Int. Cl.[4] ..... B67D 5/06

[52] U.S. Cl. ..... 222/180; 242/55.53; 206/233; 248/340

[58] Field of Search ..... 222/173, 180, 105, 106, 222/181; 248/340, 339, 311.2, 215, 318; 242/55.55, 55.53, 55.2; 118/325, 234, 75; 206/233; 215/100 A

[56] References Cited

U.S. PATENT DOCUMENTS

| | | | |
|---|---|---|---|
| 232,606 | 9/1974 | Boone | D6/06 |
| 2,362,523 | 11/1944 | Armstrong, Jr. et al. | 248/318 |
| 2,517,988 | 8/1950 | Dobkin | 222/180 |
| 2,979,301 | 4/1961 | Reveal | 248/311.2 |
| 3,243,084 | 3/1966 | Stegner | 222/105 |
| 3,652,174 | 3/1972 | Boone | 401/143 |
| 3,707,945 | 1/1973 | Boone | 118/234 |
| 3,744,448 | 7/1973 | Boone | 118/37 |
| 3,796,185 | 3/1974 | Boone | 118/325 |
| 3,824,953 | 7/1974 | Boone | 118/75 |
| 3,830,198 | 8/1974 | Boone | 118/506 |
| 3,837,595 | 9/1974 | Boone | 242/55.3 |
| 3,881,677 | 5/1975 | Ihlenfeld | 248/311.2 |
| 4,004,687 | 1/1977 | Boone | 206/233 |
| 4,093,169 | 6/1978 | Winchell | 248/318 |
| 4,106,616 | 8/1978 | Boone | 248/340 |
| 4,106,617 | 8/1978 | Boone | 206/233 |
| 4,235,333 | 11/1980 | Boone | 206/233 |
| 4,354,643 | 10/1982 | Kenner | 242/55.2 |
| 4,601,410 | 7/1986 | Bond | 222/105 |

FOREIGN PATENT DOCUMENTS

| | | | |
|---|---|---|---|
| 767349 | 1/1957 | United Kingdom | 222/181 |

*Primary Examiner*—Joseph J. Rolla
*Assistant Examiner*—Kenneth Noland
*Attorney, Agent, or Firm*—Woodard, Emhardt, Naughton, Moriarty & McNett

[57] ABSTRACT

A fluid containment chamber has hooked arms whereby it is hung from the paper roll holder spindle in a roll paper dispenser, and has a pump to dispense fluid. The pump is angled upward with operator and pump head dispensing spout at the front. The arms may be folded in a retracted position for compact shipping and storage. In another embodiment the containment chamber is integral with the cantilevered arms of the roll paper dispenser.

12 Claims, 5 Drawing Sheets

FLUID DISPENSER

BACKGROUND OF THE INVENTION

The present invention relates generally to the field of fluid dispensers and more specifically to the field of fluid dispensers integrated with dispensers of roll paper such as toilet paper or paper towels The prior art includes various devices attached to or integrated in a toilet paper dispenser. In U.S. Pat. No. 3,848,822 to Boone a device is disclosed for dispensing moist sheets or liquid spray from a containment means located within a toilet paper roll tube. U S. Pat. No. 2,746,798 to Wardell, Jr. and U.S. Pat. No. 2,806,738 to Tsakalas disclose similar intra-tube devices for deodorizing purposes.

Other approaches have means for storing extra rolls of toilet paper from a toilet paper dispenser. One such device is disclosed by U.S. Pat. No. 3,297,265 to Turro in which a telescopically mating spindle for holding toilet paper is suspended below the spindle of the toilet paper dispenser. U.S. Pat. No. Des. 259,682 discloses another such device wherein the spare toilet paper roll is held in a trough suspended below the spindle of the toilet paper dispenser.

The present invention is an improvement in that it provides means for the user to conveniently access a supply of fluid from a toilet paper dispenser. In one embodiment of the present invention a device may be suspended from most any design of standard toilet paper dispenser. The prior art known to me only allows for dispensing to occur from within the roll of toilet paper. Also, the prior art known to me only allows fluid dispensing from roll dispensers such as ones having a specialized hanging wire loop suspending the roll of paper or ones in which the roll spindle is retrofitted to be out of alignment with its originally designed position. The present invention overcomes these limitations.

The present invention also positions a pump fixture in an orientation more convenient to the user. By orienting the pump axis perpendicular to the axis of rotation of the roll paper, the pump is more readily accessible in some applications than if the pump were located within the spindle. This advantage is enjoyed both when the pump is suspended below the roll of paper and when the pump is located in a cantilevered arm suspending the roll of paper.

The present invention is particularly useful to users needing a supply of cream for treatment of hemorrhoidal inflammation. It is very convenient for persons having to apply hemorrhoidal cream to have it located near a toilet. This invention is particularly well suited to solve this need since toilet paper dispensers are located near toilets.

The present invention is also useful for dispensing other fluids including skin lotions, soaps, aerosol sprays, aerosol foams, and gases. In addition to toilet paper dispensers, the present invention has application to roll dispensers such as paper towel dispensers.

The present invention provides an improved means in which fluids may be packaged in order to more conveniently facilitate their use. For example, hemorrhoidal cream could come packaged in a container embodying the present invention. Such packaging may be disposable or nondisposable or have disposable refills.

SUMMARY OF THE INVENTION

According to one embodiment of the present invention, a device for dispensing a fluid and toilet paper comprises: a housing having a pair of cantilevered arms spaced apart a width greater than the width of a standard toilet paper roll, the cantilevered arms each having a rounded recess disposed therein; a toilet paper spindle mounted between the cantilevered arms, the spindle having, a pair of ends, a central axis and a pair of outwardly extending hubs affixed at either end of the spindle and concentric with the central axis, the hubs engagably mounted in the rounded recesses; a fluid container suspended by the housing and having a containment chamber, an opening, and at least one containment wall; a fluid pump mounted in the opening, the fluid pump having a manually reciprocally operable pump head and a pump axis, the pump head reciprocally movable along the pump axis, the pump axis being perpendicular to the central axis of the spindle.

One object of the present invention is to provide a liquid dispenser.

Related objects and advantages to the present invention will be apparent from the following description.

DESCRIPTION OF THE PREFERRED EMBODIMENT

Figure 1:
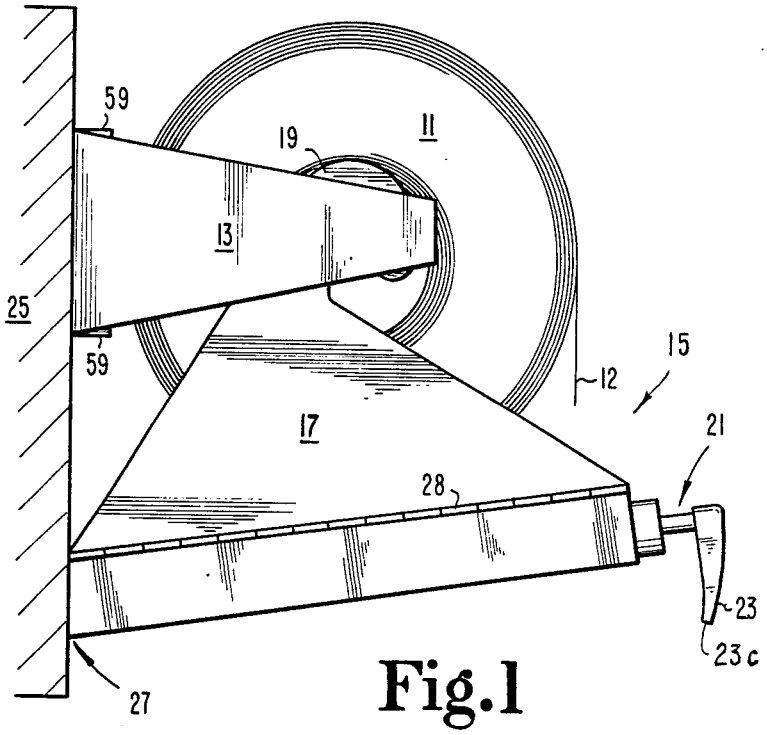
FIG. 1 is a side view of one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
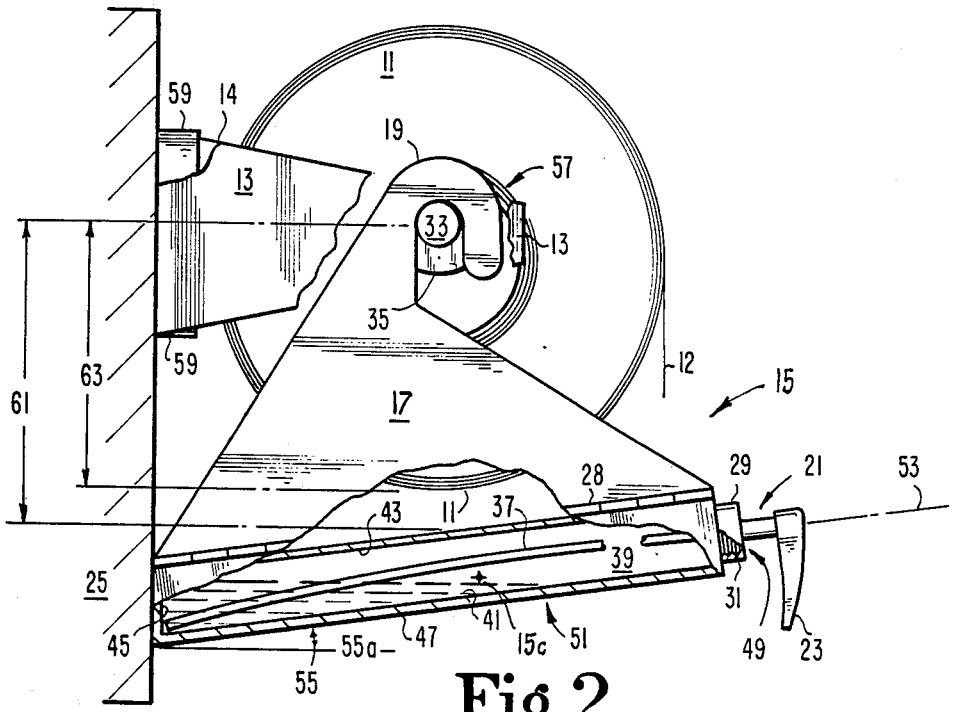
FIG. 2 is a partial cutaway side view of the device of FIG. 1.

Referring now to FIGS. 1, 2, 3 and 4, toilet paper roll 11, typically about 4½ inches wide, is suspended between a pair of cantilevered arms 13 and 14, and preferably with the paper end 12 out, away from wall 25, as shown in FIGS. 1, 2. 3 and 4. Fluid dispensing device 15 is suspended from wall-mounted, cantilevered arms 13 and 14 by hanger arms 17 and 18 which include hook-like upper ends 19 and 20. Fluid dispensing device 15 includes fluid pump 21 having a pump head 23. pump 21 is a standard off-the-shelf manually reciprocally operated pump for dispensing fluids. Such pumps are frequently found in containers for dispensing hand lotion, soaps and the like. Arms 13 and 14 are mounted to wall mount 59 which is mounted to building wall structure 25. Wall mount 59 is similar to wall mount 359 shown in FIGS. 7, 8 and 9, except that wall mount 59 is positioned between arms 13 and 14 whereas wall mount 359 is positioned behind arms 313 and 314. It will be recognized that the present invention can be employed with a great variety of wall mountings.

A conventional toilet paper spindle 35 such as is commonly available, and having tapered end post portions 33, is supported between and by the arms 13 and 14. Spindle 35 typically is telescopically collapsible along its axis 36 (FIG. 4) to facilite mounting between the arms. The upper ends 19 and 20 of hanger arms 17 and 18, respectively, are hooks suitably sized to hook over posts 33. The upper ends 19 and 20 of arms 17 and 18 may, in an alternative embodiment (not shown), be in the form of a complete loop, rather than a hook, around posts 33.

In FIG. 2, first arm 13 and fluid dispensing device 15 are partially cut away to show fluid container and pump details. A fluid container 51 includes a containment chamber 39 defined by a plurality of containment walls such as upper containment wall 43, rear containment wall 45, bottom containment wall 47, side containment walls and a front containment wall. Chamber 39 has one opening 49 which is in the front containment wall and surrounded by the threaded neck or lip 31 which is covered by cap 29 and fluid pump 21. Cap 29 is internally threaded, surrounding pump 21 and is threaded onto externally threaded lip 31.

Fluid pump 21 includes pump tube 37 inside of containment chamber 39. Fluid 41 is kept in containment chamber 39 and dispensed out of fluid pump 21 by way of pump tube 37 and dispensed from outlet **23*e* when the pump head 23 is pushed toward the wall 25**.

Fluid dispensing device 15, although preferably made of plastic, is preferably proportioned or weighted so its center of gravity **15*c* (FIG. 2) is farther from wall 25 than is a line through the posts 33, so the device normally abuts wall 25 at back side 27. The pump user typically will be on the front side of the paper roll dispenser, while the building wall structure 25 is behind the dispenser. The abutting at back side 27 acts to forceably resist the pumping motion the operator causes when he pushes the pump head 23 on the plunger of pump 21. Note that similar forceable resistance is provided in the other embodiment illustrated in FIGS. 6, 7, 8 and 9. The removable cap 29 on opening 49 allows refilling of containment chamber 39 with fluid 41**.

Pump head 23 of fluid pump 21 is manually reciprocally operated along pump axis 53. This axis is oriented at a convenient upward angle 55 relative to horizontal **55*a*. For reliable positive action against the backing, to achieve the above mentioned forceable resistance, it is desirable that the pump axis 53 lie in a plane perpendicular to the wall 25, and that pump axis 53 is perpendicular to a plane containing the axis of rotation (not shown) of paper roll 11 and is directed outwardly from building wall structure 25. The axis of rotation of paper roll 11 is that axis which is concentric with the cylindrical shape of paper roll 11 and parallel to central axis 36 as shown in FIG. 4**.

As evident from the above description, fluid container 51 is suspended by arms 17 and 18 below paper roll dispenser 57. Container 51 is suspended below the roll dispenser 57 a distance determined by ar length 61 of arms 17 and 18. Arm length 61 is greater than radius 63 from spindle axis 36 (FIG. 4) to the bottom of paper roll 11. In this way, the roll will not rub against upper containment wall 43 during dispensing of paper from the roll.

Figure 3:
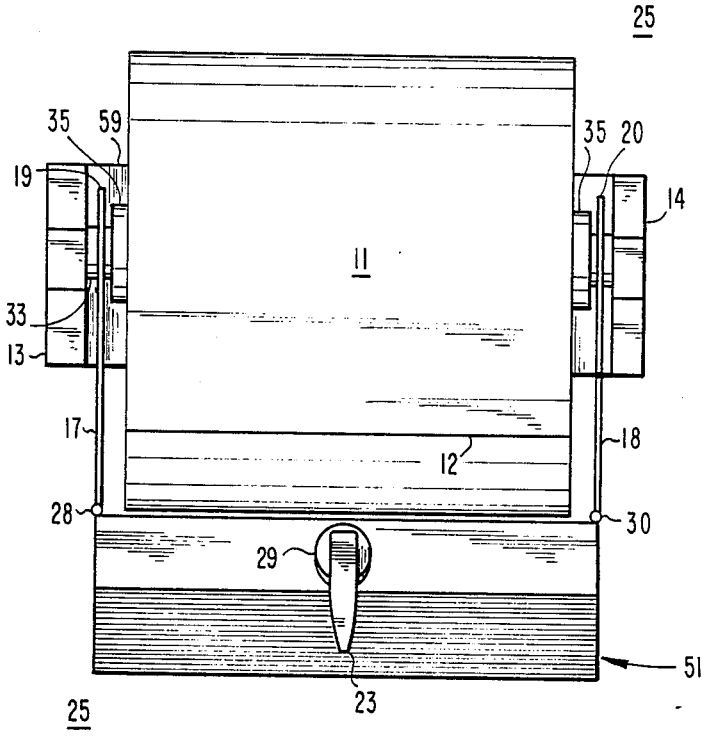
FIG. 3 is a front view of the device of FIG. 1.
Figure 4:
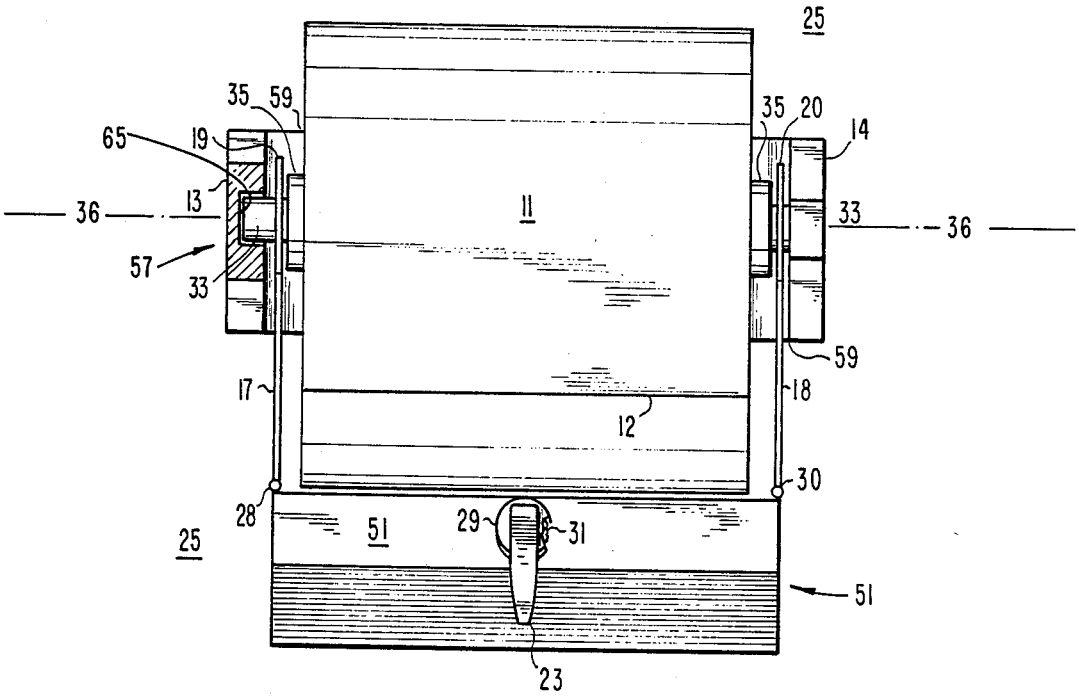
FIG. 4 is a partial cutaway front view of the device of FIG. 3.

FIG. 4 includes a partial cutaway front view of arm 13 of FIG. 3 which has recess or socket 65 in it, as does arm 14. Posts 33 are located in recesses 65. Cap 29 is partially cut away to show containment chamber lip 31. Connecting means are provided at 28 and 30 and allow arms 17 and 18 to be disconnected from or folded downwardly onto fluid container 51 as shown for arm 17, for example, in FIG. 5. This facilitates initial packaging, storage and shipment. The materials are preferably plastic. The connecting means 28, 30 are shown as "piano hinges" to emphasize the location. However, for separate arms, they can include a groove molded into the lower edge of the arm, and an upstanding rib or rail molded along the upper corner of the container at each side, with the arm longitudinally slided onto the rib, in a dovetail or other suitably interconnecting relationship of the rib and groove. Another approach would make the arms and container integral, but use the well known "living hinge" technique at 28 and 30 so arms 17 and 18 may be folded down onto the flat, top portion of fluid container 51 for packing and shipping.

Figure 5:
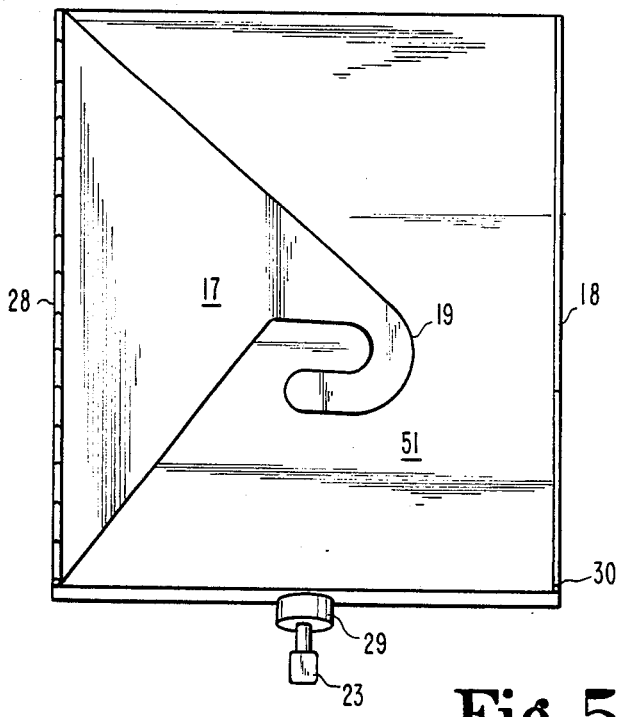
FIG. 5 is a top view of the device of FIG. 1 with one of the hanger arms folded flat.

FIG. 5 illustrates a top view of the fluid container 51 together with fluid pump 21, first arm 17 folded down and second arm 18 raised, to show how the arms fold for shipping. In FIG. 5, building wall structure 25, paper roll dispenser 57, and paper roll 11 are not shown.

Figure 6:
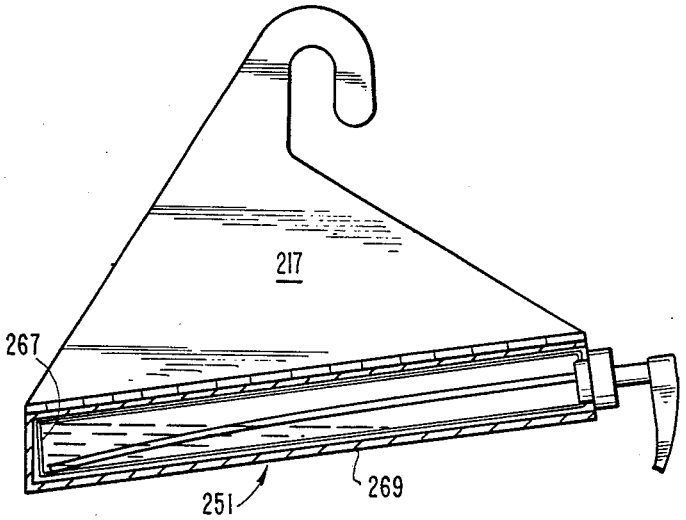
FIG. 6 is a partial side cutaway view of an alternative embodiment of the present invention.

FIG. 6 shows an alternative embodiment of the present invention. It differs from that of FIGS. 1–5 in that it has an inner refill shell 267 located within outer shell 269. Collectively, inner refill shell 267 and outer shell 269 make up fluid container 251. Inner refill shell 267 is slidably disposed in outer shell 269. Thus, when inner refill shell 267 is empty or needs replacement, it may be removed and replaced without having to replace outer shell 269 with its attached hanger arms such as 217.

Figure 7:
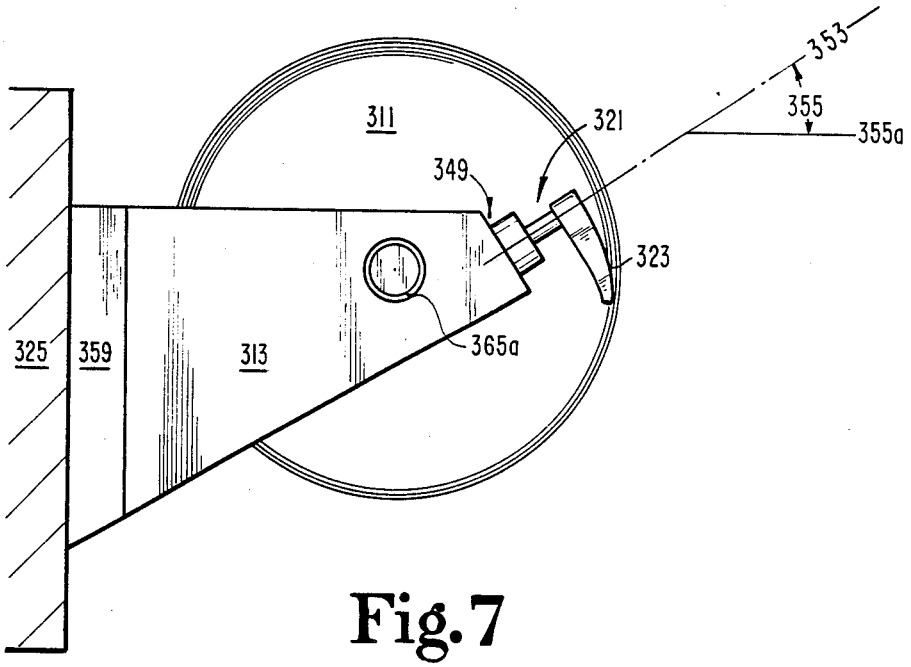
FIG. 7 is a side view of another alternative embodiment of the present invention.
Figure 8:
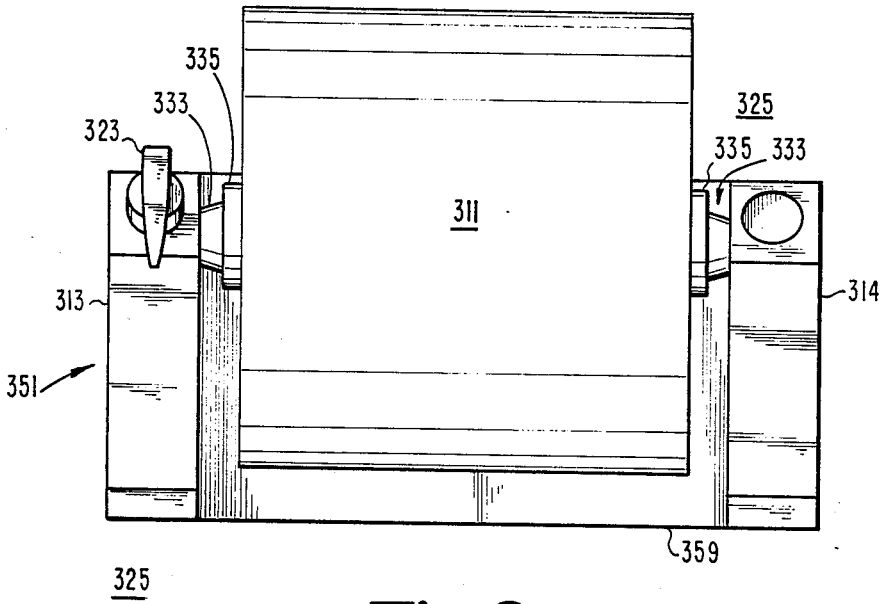
FIG. 8 is a front view of the device of FIG. 7.
Figure 9:
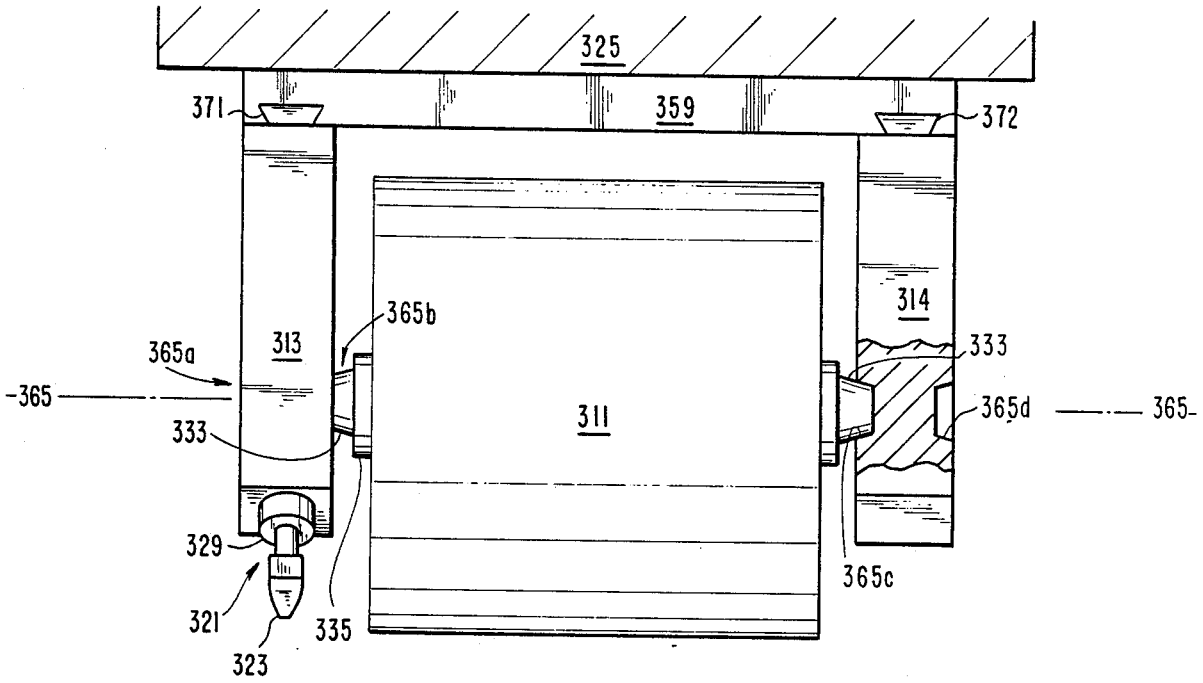
FIG. 9 is a partial cutaway top view of the device of FIG. 8.

FIGS. 7, 8 and 9 illustrate a second alternative embodiment of the present invention. First and second cantilevered arms 313 and 314 are attached to wall mount 359 which in turn is fastened to building wall structure 325. Paper roll 311 is suspended and supported on spindle assembly 333, 335 between arms 313 and 314. Fluid pump 321 is mounted in opening 349. Opening 349 is substantially similar to opening 49 in FIG. 2. Likewise, pump 321 has pump head 323 which is substantially similar to pump head 23 in FIG. 2, pump axis 353 is oriented in an upward angle 355 relative to horizontal **355*a*. Pump head 323 is manually reciprocally operable along pup axis 353 and, like pump 21 in FIG. 2**, is a standard item.

FIG. 8 illustrates a front view of the device illustrated in FIG. 7. Fluid container 351 is disposed in arm 313. In the illustrated embodiment, fluid container 351 is the same and defined by ar 313 which is hollow. Arm 314 is of similar geometry to arm 313, but does not have fluid pump 321 mounted in it. Arm 314 is a dummy version of arm 313. However, this embodiment of the present invention would be practiced also if second cantilevered arm 314 had a pump and fluid container disposed in it substantially similar to arm 313. Spindle 335 supports paper roll 311 by having its posts 333 bearing in recesses such as **365*c* (FIG. 9) which is like 365*a* in FIG. 7. Spindle 335 typically is telescopically collapsible along axis 365 to facilite mounting between arms 313 and 314** just as in the first embodiment.

Recess 365a (FIG. 7) is located on the outside of arm 313. There is a corresponding recess (not shown) on the inside of arm 313. This allows interchangeability of arms on either side of the wall mount 359 when arms are replaced.

FIG. 9 illustrates a top view of the device illustrated in FIGS. 7 and 8. FIG. 9 has a partial cutaway portion to illustrate recesses 365c and 365d supporting post 333. Central axis 336 is concentric with spindle 335. Recesses 365c and 365d are located in both sides of arm 314. Similar recesses exist in arm 313. Fluid pump 321 has a cap 329 which is substantially similar to cap 29 in FIG. 2. Cap 329 in the preferred embodiment is a threaded cap, threading around a threaded lip (not shown in FIG. 9). Wall mount 359 is mounted to building wall structure 325. Arm 313 is mounted to wall mount 359 by way of channel lock or key 371. Similarly, arm 314 is mounted to wall mount 359 by channel lock 372. In this way. each cantilevered arms may be removed by sliding it vertically away from wall mount 359. In this way, cantilevered arms such as arm 313 may be removed and replaced. When, for example, first cantilevered arm 313 is used as a fluid container 351, it may be readily removed and replaced when it is empty.

Although the embodiments discussed herein deal with toilet paper, the present invention may just as well work with other forms of paper dispensers including paper towel dispensers. Fluids to be dispensed may include hemorrhoidal cream, soaps, aerosol foams, aerosol sprays, hand lotions, and other liquids. Fluid containers may be either disposable or nondisposable.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A fluid dispensing device suitable for attachment to a paper roll dispenser comprising:

fluid container means;

suspending means attached to said fluid container means to suspend said fluid container means from the paper roll dispenser; and fluid dispenser means on said container means arranged to pump fluid from said container means, wherein said suspending means has hinge means secured to said fluid container means for collapsing said suspending means for storage, wherein said suspending means includes a first arm and a second arm, said first arm having a first upper end, said second arm having a second upper end, wherein said first upper end is spaced a distance from said second upper end, said distance greater than the width of the paper roll to be dispensed by the paper roll dispenser to allow said first arm and said second arm to hang on each side of the paper roll.

2. The device of claim 1 wherein said first arm has a first arm length and said second arm has a second arm length, and wherein said first arm length and said second arm length are each greater than the radius of an unused paper roll to be dispensed by the paper roll dispenser.

3. The device of claim 2 wherein said first arm length and said second arm length are each shorter than the diameter of an unused paper roll to be dispensed by the paper roll dispenser.

4. The device of claim 2 wherein said fluid container means includes an outer shell and an inner refill shell, said inner refill shell removably mounted within said outer shell, and said inner refill shell containing a fluid therein.

5. The device of claim 1 wherein said first upper end and said second upper end each include hook means.

6. The device of claim 5 wherein said container means include a fluid container with an opening and the fluid dispenser means includes a fluid pump, the device further comprising a threaded cap and a threaded lip, said threaded cap rotably surrounding said fluid pump, said threaded lip affixed to said fluid container surrounding said opening, said threaded cap engaging said threaded lip.

7. The device of claim 6 in combination with a building wall structure and a paper roll dispenser, wherein said fluid container includes a back side and wherein said paper roll dispenser is mounted to said building wall structure, wherein said back side of said fluid container abuts against said building wall structure when said fluid container is suspended below said paper roll dispenser by said suspending means.

8. The device of claim 5 in combination with a building wall structure and a paper roll dispenser, wherein said fluid container means has a center of gravity farther from said wall than are said hood means, and said fluid container means includes a back side, and wherein said paper roll dispenser is mounted to said building wall structure, and wherein said back side of said fluid container means abuts against said building wall structure when said fluid container means is suspended below said paper roll dispenser by said suspending means.

9. The device of claim 5 in combination with a building wall structure, wherein said fluid pump has a manually reciprocally operable pump head and a pump axis, said pump head reciprocally movable along said pump axis, said pump axis projecting in an outward direction from said building wall structure.

10. The device of claim 5 and further including a fluid, said containment chamber containing said fluid.

11. A fluid dispensing device suitable for attachment to a paper roll dispenser comprising:

fluid container means, wherein said fluid container means includes an outer shell and an inner refill shell, said inner refill shell removably mounted within said outer shell, and said inner refill shell containing a fluid therein;

suspending means attached to said fluid container means and adapted to suspend said fluid container means from the paper roll dispenser, wherein said suspending means includes a first arm and a second arm, said first arm having a first upper end, said second arm having a second upper end, wherein said first upper end is spaced a distance from said second upper end, said distance greater than the width of the paper roll to be dispensed by the paper roll dispenser to allow said first arm and said second arm to hang on each side of the paper roll, wherein said first arm has a first arm length and said second arm has a second arm length, wherein said first arm length and said second arm length are each greater than the radius of an unused paper roll to be dispensed by the paper roll dispenser, and wherein said first arm and said second arm are hingedly secured to said fluid container outer shell and are collapsible thereon for storage; and fluid dispenser means on said container means arranged to pump fluid from said container means.

12. A fluid dispensing device suitable for attachment to a paper roll dispenser comprising:

fluid container means;

suspending means attached to said fluid container means and adapted to suspend said fluid container means from the paper roll dispenser, wherein said suspending means includes a first arm and a second arm, said first arm having a first upper end, said second arm having a second upper end, wherein said first upper end is spaced a distance from said second upper end, said distance greater than the width of the paper roll to be dispensed by the paper roll dispenser to allow said first arm and said second arm to hang on each side of the paper roll, wherein said first upper end and said second upper end each include hook means, wherein said first arm and said second arm are hingedly secured to said fluid container and wherein said fluid container includes an upper containment wall upon which said hingedly secured first arm and hingedly secured second arm are collapsible; and fluid dispenser means on said container means arranged to pump fluid from said container means.

* * * * *